US012366378B2

(12) United States Patent
Garg et al.

(10) Patent No.: US 12,366,378 B2
(45) Date of Patent: Jul. 22, 2025

(54) CONDENSATE DRAIN SYSTEM OF AN HVAC UNIT

(71) Applicant: Johnson Controls Technology Company, Auburn Hills, MI (US)

(72) Inventors: Karan Garg, Jagadhri (IN); Sriram Ramanujam, Chennai (IN); Mujibul R. Mohammad, Kakinada (IN); Praveen M. Gotakhindi, Pune (IN); Amit R. Chothave, Pune (IN)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 351 days.

(21) Appl. No.: 17/235,703

(22) Filed: Apr. 20, 2021

(65) Prior Publication Data

US 2021/0333011 A1 Oct. 28, 2021

(30) Foreign Application Priority Data

Apr. 20, 2020 (IN) ..... 202011016870

(51) Int. Cl.
*F24F 13/22* (2006.01)

(52) U.S. Cl.
CPC ..... *F24F 13/222* (2013.01)

(58) Field of Classification Search
CPC ..... F24F 13/222; F24F 13/22; F24F 13/224
See application file for complete search history.

(56) References Cited

U.S. PATENT DOCUMENTS 2,822,674 A * 2/1958 Simmons ..... F24F 1/0067 62/317
4,248,057 A * 2/1981 Yaguchi ..... F24F 13/224 62/183
4,416,327 A * 11/1983 Nakada ..... F24F 13/22 62/262
6,895,770 B1 * 5/2005 Kaminski ..... F24F 13/222 62/285
2012/0031134 A1 * 2/2012 Shirota ..... F24F 13/222 62/288

(Continued)

FOREIGN PATENT DOCUMENTS

JP 59122832 A * 7/1984
JP 59153042 A * 8/1984

(Continued)

OTHER PUBLICATIONS

English Machine Translation of JP-59153042. Accessed Jun. 2023.*

*Primary Examiner* — Tavia Sullens
(74) *Attorney, Agent, or Firm* — Fletcher Yoder, PC

(57) ABSTRACT

A heating, ventilation, and air conditioning (HVAC) unit includes a blower support frame and a condensate drain panel assembly. The blower support frame is configured to support one or more blowers of the HVAC unit. The condensate drain panel assembly includes a first condensate drain panel coupled to the blower support frame at a first angle relative to horizontal, a second condensate drain panel coupled to the blower support frame at a second angle relative to horizontal, and a cover panel. The condensate drain panel assembly is configured to direct condensate away from the blower support frame and towards a main condensate drain pan.

18 Claims, 13 Drawing Sheets

(56) References Cited

U.S. PATENT DOCUMENTS

| | | | | |
|---|---|---|---|---|
| 2013/0008526 | A1* | 1/2013 | Rowland | F24F 13/222<br>137/312 |
| 2020/0041165 | A1* | 2/2020 | Pistone | F24F 13/222 |
| 2020/0041166 | A1* | 2/2020 | Rokade | F24F 13/222 |

FOREIGN PATENT DOCUMENTS

| | | | | |
|---|---|---|---|---|
| KR | 200312184 | Y1 * | 5/2003 | F24F 13/222 |
| WO | WO-2019220164 | A1 * | 11/2019 | F24F 13/222 |

* cited by examiner

CONDENSATE DRAIN SYSTEM OF AN HVAC UNIT

CROSS REFERENCE TO RELATED APPLICATION

This application claims priority from and the benefit of India Provisional Application Serial No. 202011016870, entitled "A SYSTEM AND METHOD FOR AN ENHANCED AIRFLOW IN A ROOF TOP UNIT," filed Apr. 20, 2020, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. For example, an HVAC system may include a blower configured to generate an airflow and a heat exchangers, such as a heat exchanger configured to place the air flow in a heat exchange relationship with a refrigerant of a vapor compression circuit, a heat exchanger configured to place the air flow in a heat exchange relationship with combustion products, or both. In general, the heat exchange relationship(s) may cause a change in pressures and/or temperatures of the air flow, the refrigerant, the combustion products, or any combination thereof. As the temperatures and/or pressures of the above-described fluids change, liquid condensate may be formed in or on the associated heat exchangers.

In traditional systems, a condensate pan may be positioned directly below a heat exchanger of the HVAC system to collect condensate formed in or on the heat exchanger. When the system is operating in high humidity conditions with high air velocities, the rate of condensate generation may be increased. Additionally, due to the high air velocities, condensate may be carried by the air into a section of a blower frame that is downstream of the heat exchanger. Unfortunately, traditional condensate collection and drainage systems may be inadequate for collecting and draining the condensate that is carried downstream of the heat exchanger (e.g., condensate carryover), which may lead to system wear and/or degradation cause by water and/or air, operating interruptions, and other undesirable effects within the HVAC system. Further, traditional systems may utilize reduced air velocities to prevent condensate carryover, which may limit operation and/or reduce efficiency of the HVAC systems.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a heating, ventilation, and air conditioning (HVAC) system comprises a blower support frame configured to support a blower of the HVAC system, and a first condensate drain panel coupled to the blower support frame at a first angle relative to horizontal. The HVAC system further comprises a second condensate drain panel coupled to the blower support frame at a second angle relative to horizontal, wherein the second condensate drain panel extends from the first condensate drain panel and from the blower support frame.

In another embodiment, a heating, ventilation, and air conditioning (HVAC) unit comprises a blower assembly and a condensate drain system. The blower assembly comprises a support frame and a blower coupled to the support frame. The condensate drain system comprises a first panel coupled to the support frame at a first angle relative to horizontal, wherein the first panel is positioned beneath the blower relative to gravity and is configured to capture condensate and direct the condensate out of the support frame. The condensate drain system also comprises a second panel coupled to the support frame at a second angle relative to horizontal, wherein the second panel extends from the first panel and from the support frame and is configured to direct the condensate from the first panel to a drain pan of the HVAC unit.

In another embodiment, a condensate drain assembly for a heating, ventilation, and air conditioning (HVAC) system comprises a first condensate drain panel, a second condensate drain panel, and a drain pan. The first condensate drain panel is configured to couple to a blower support frame of the HVAC system at a first angle relative to horizontal and beneath a blower supported by the blower support frame relative to gravity. The second condensate drain panel is configured to couple to the blower support frame and extend outwardly from the blower support frame, wherein the second condensate drain panel is configured to be disposed at a second angle relative to horizontal, wherein the second angle is greater than the first angle. The drain pan is configured to be disposed beneath a heat exchanger of the HVAC system relative to gravity, and the second condensate drain panel extends from the first condensate drain panel to the drain pan in an assembled configuration of the condensate drain assembly.

DRAWINGS

Various aspects of this disclosure may be better understood upon reading the following detailed description and upon reference to the drawings in which.

DETAILED DESCRIPTION

Figure 1:
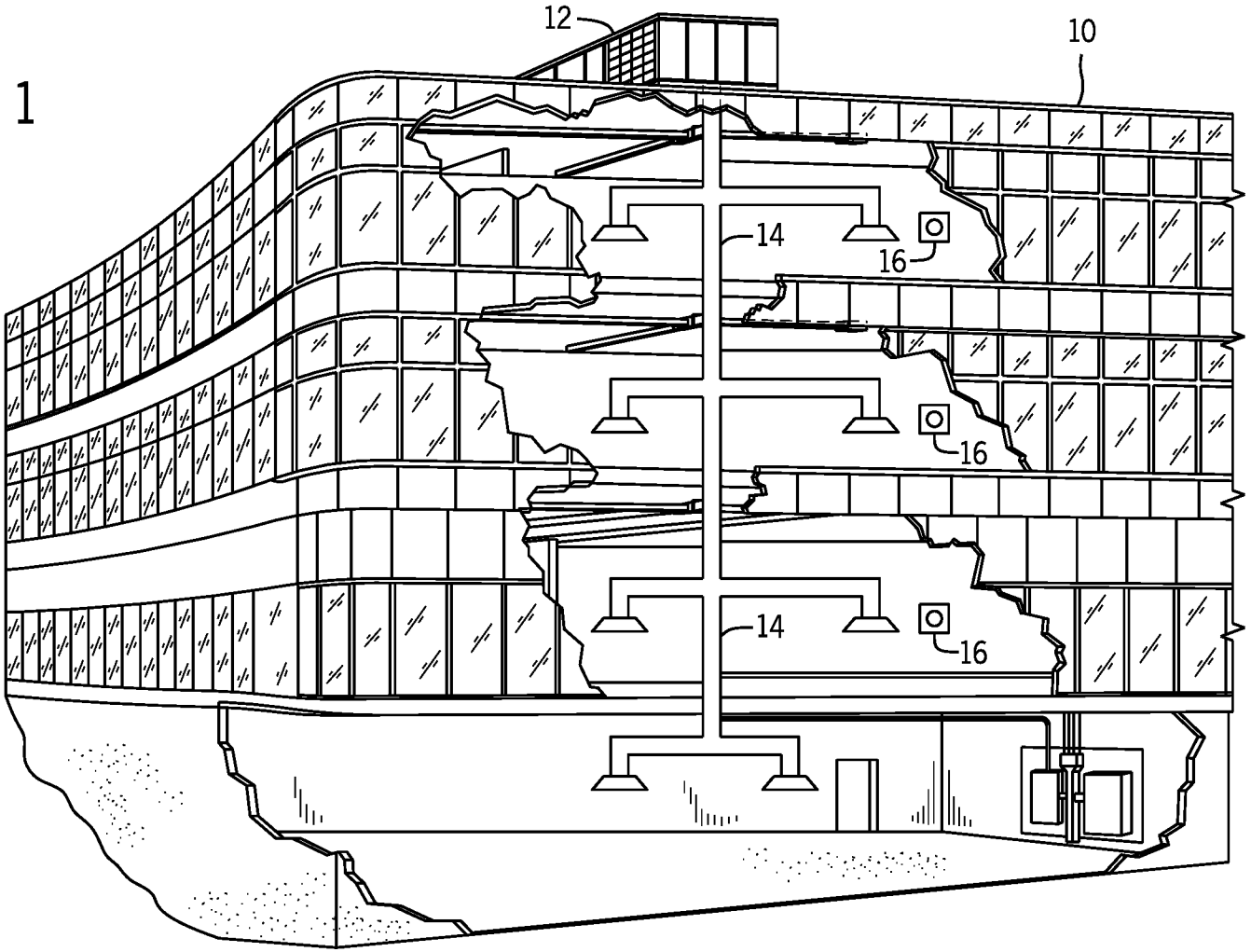
FIG. 1 is a perspective view of a building having an embodiment of a heating, ventilation, and/or air conditioning (HVAC) system for environmental management that may employ one or more HVAC units, in accordance with an aspect of the present disclosure.

The present disclosure relates generally to a heating, ventilation, and air conditioning (HVAC) systems, and more particularly, to a condensate drain system configured to collect and drain a flow of condensate from the HVAC system.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may include a vapor compression circuit that circulates a refrigerant for conditioning a supply air flow, a combustion cycle that circulates combustion products for conditioning the supply air flow, or a combination thereof. For example, the vapor compression circuit may include at least one heat exchanger configured to receive the refrigerant. Further, at least one blower may be employed and configured to direct the supply air flow over the at least one heat exchanger. The supply air flow may then be directed into a space to condition the space. In some embodiments, the vapor compression circuit may be a heat pump that provides, via the supply air flow, both heating and cooling to the conditioned space. For example, a refrigerant flow through the vapor compression system may be reversed to change the vapor compression system from a heating mode to a cooling mode and vice versa. Accordingly, in a first operating mode (e.g., heating mode) of the vapor compression system, a first heat exchanger may act as a condenser and a second heat exchanger may act as an evaporator, whereas in a second operating mode (e.g., cooling mode) of the vapor compression system, the first heat exchanger may act as an evaporator and the second heat exchanger may act as a condenser.

Additionally or alternatively, the HVAC system may include a combustion cycle employing a furnace (e.g., a condensing furnace) configured to provide a heated supply air flow to the conditioned space. For example, the furnace may include a heat exchanger having tubing that is configured to receive relatively hot combustion products (e.g., ignited flue gas). The blower mentioned above and/or another blower may be configured to direct the supply air flow across the tubing, thereby placing the supply air flow in a heat exchange relationship with the relatively hot combustion products to heat the supply air flow. Thereafter, the heated supply air flow may be directed into the conditioned space.

In some circumstances, condensate may form in or on various of the above-described heat exchangers during operation of the HVAC system, such as the condensing heat exchanger of the vapor compression circuit and/or the heat exchanger of the furnace. For example, the blower may generate an air flow that is cooled and dehumidified as it passes across the heat exchanger of the vapor compression circuit, thereby causing moisture contained within the air flow to condense. In traditional systems, condensate management systems are configured to remove at least some of the condensate from the heat exchanger before it may be released back into the system or into the environment. Unfortunately, traditional systems may be positioned and configured to merely collect condensate that falls from the heat exchanger via gravity and are therefore inadequate for collecting and draining excess condensate that is carried downstream of the heat exchanger by the air flow. To mitigate the potential of condensate carryover downstream of the heat exchanger, traditional systems may operate to reduce a flow rate of the air, which may limit performance and/or efficiency of the systems.

It is now recognized that improved condensate collection and drainage systems, in accordance with the present disclosure, can improve the collection and drainage of excess condensate that is carried downstream of the heat exchanger, thereby enabling operation of the HVAC system at enhanced air flow rates. Further, various components of the HVAC system may be protected, thereby limiting potential wear and degradation of the HVAC system that may develop as a result of condensate carryover. For example, a condensate drain system may include a condensate drain assembly having a first condensate drain panel coupled to a blower frame and a second condensate drain panel coupled to the first condensate drain panel. The first and second condensate drain panels may be positioned to enable the collection of condensate that is carried downstream of the heat exchanger. In this way, the condensate drain assembly may provide protection to additional components of the HVAC system that would be otherwise unprotected in traditional systems. That is, use of the presently disclosed condensate drain assembly may reduce a likelihood of wear and degradation to the HVAC system and its components (e.g., electronics) that may be caused by water presence and/or air pressure during operation of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or one or more zones (101, 102, 103) of the building 10 and each zone may further comprise one or more outdoor air hoods equipped with filters. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
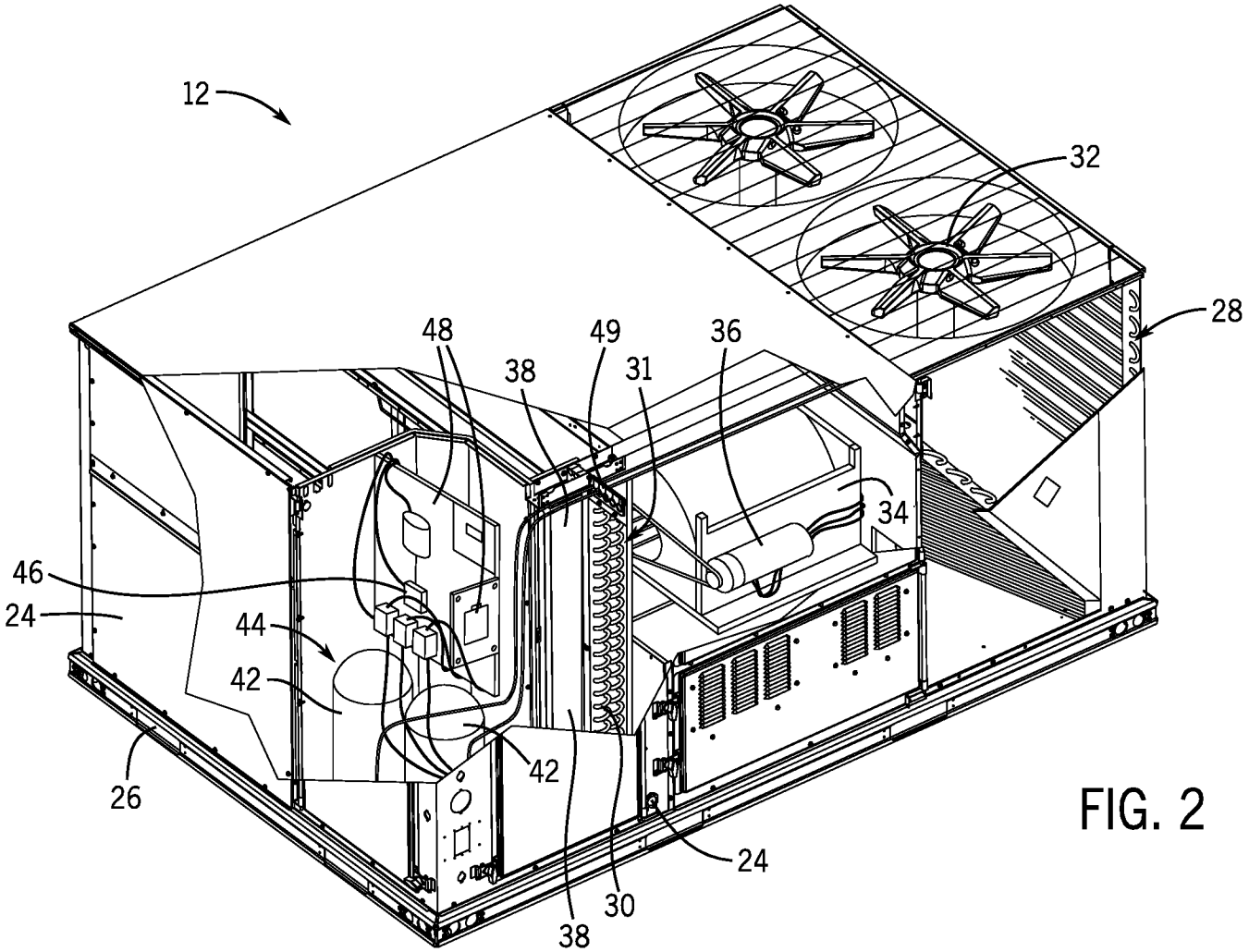
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
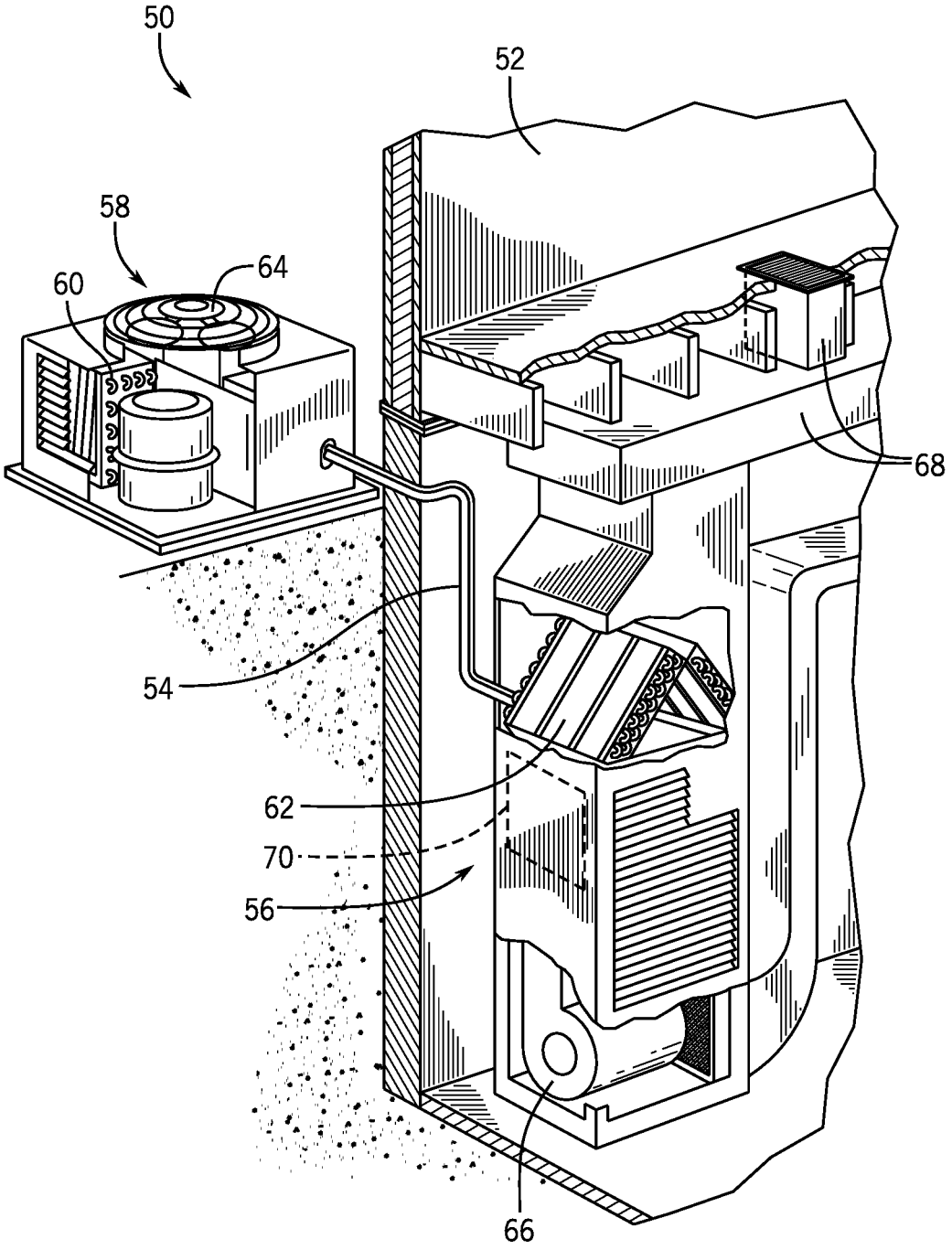
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
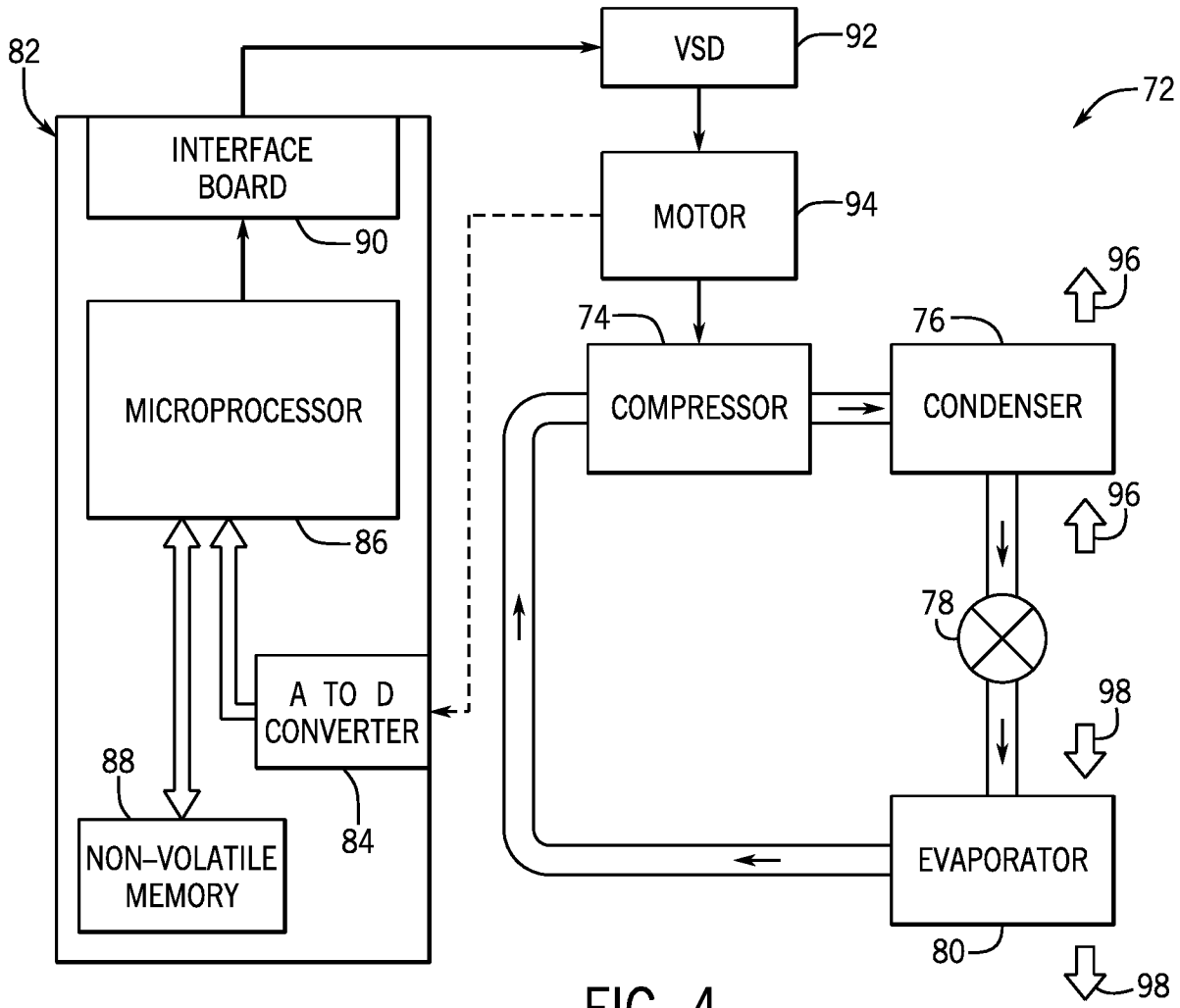
FIG. 4 is a schematic illustration of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, one of ordinary skill in the art will appreciate that any of the systems illustrated in FIGS. 1-4 may generate condensate as an air flow is directed across a heat exchanger (e.g., heat exchanger 30 of the HVAC unit 12 in FIG. 2) by a fan or blower. For example, as the air flow loses heat to the heat exchanger, liquid condensate may form on the heat exchanger and may be blown or carried downstream of the heat exchanger by the air flow. The presently disclosed techniques may be utilized with any of the systems described above, as well as other HVAC systems, to improve collection and drainage of condensate and to improve operation of the system via enhance air flow capabilities.

In accordance with the present disclosure, a condensate drain panel assembly (e.g., condensate drain system, condensate drain assembly) may be utilized to collect and drain the above-described liquid condensate. The condensate drain pan assembly may be coupled to a blower frame and positioned downstream of a heat exchanger to enhance the liquid condensate collection capabilities of the HVAC system. For example, when environmental conditions (e.g., humidity levels and temperatures), such as conditions within a space serviced by the HVAC system, are above a threshold value (e.g., greater than 60%, 70%, 80% humidity or greater than 80° F., 90° F., 100° F.), the HVAC system may operate to increase a speed of the blowers or fans in order to meet the demands of the space. As the speed of the blowers and fans increases, the flow rate of the air flow induced across the heat exchanger may also increase, which may cause condensate formed on the heat exchanger to be blown or carried downstream by the air flow. Increased fan and blower speed resulting in increased condensate carryover may cause wear and/or degradation to components of the HVAC system and/or the surroundings of the HVAC system. By installing the disclosed condensate drain pan assembly downstream of the heat exchanger, various components of the HVAC system may be protected, and as a result, the HVAC system may enable an enhanced air flow via increased blower speeds while also mitigating the potential of undesirable effects traditionally caused by liquid condensate that is generated and blown or carried downstream from the heat exchanger.

Figure 5:
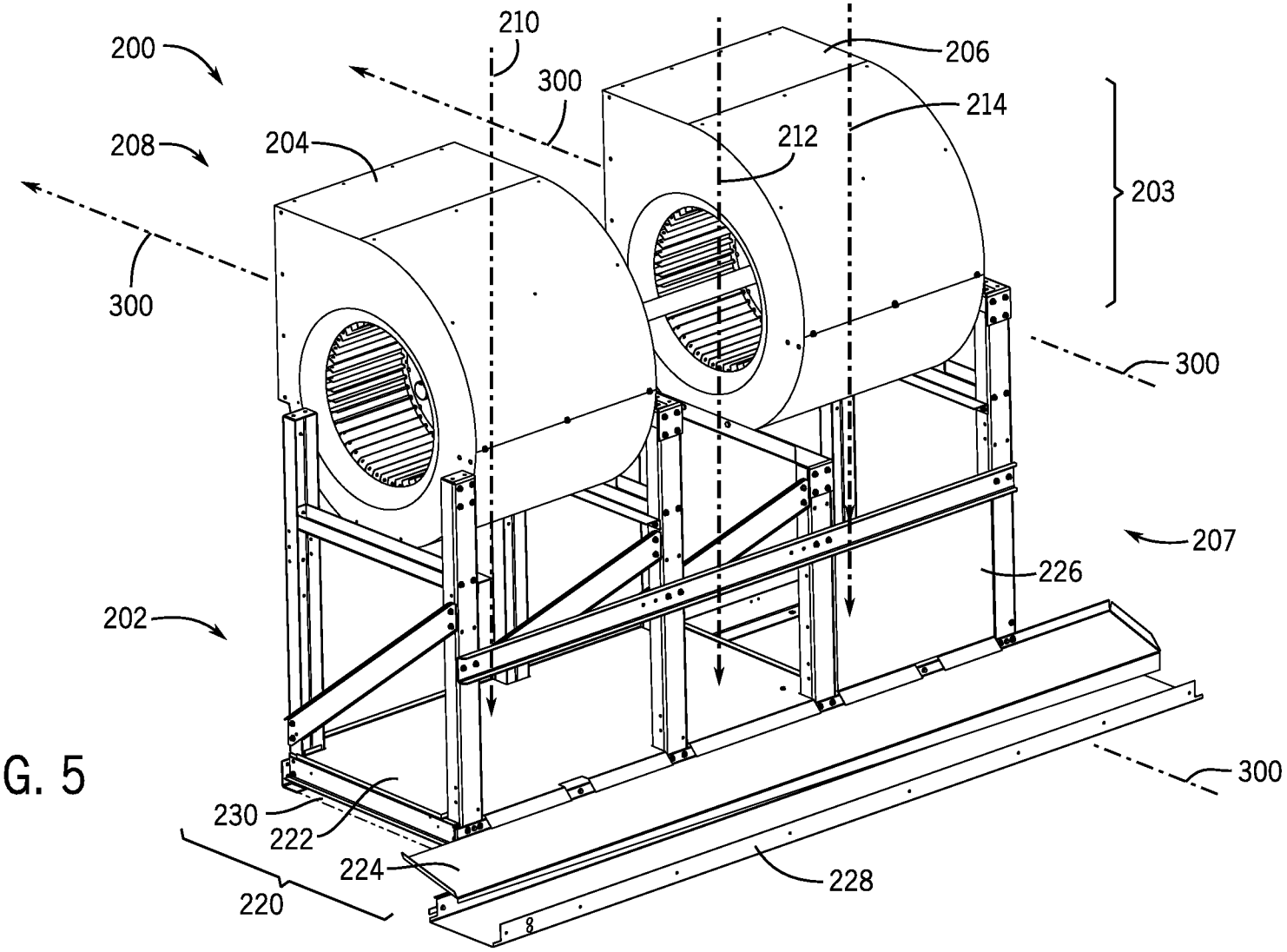
FIG. 5 is a perspective view of an embodiment of a condensate drain system for an HVAC unit, in accordance with an aspect of the present disclosure.

With this in mind, FIG. 5 is a perspective view of an embodiment of a system 200 (e.g., HVAC system, condensate drain system, enhanced air flow system) configured to provide improved collection and drainage and condensate and enhanced airflow in an HVAC system. The illustrated embodiment is intended to focus on certain features that enable the functionalities and benefits of the presently disclosed techniques, but it should be appreciated that the system 200 may include additional features, such as components described above with reference to FIGS. 1-4. The system 200 includes a blower support frame 202 configured to be positioned downstream of a heat exchanger (not shown) and to support a blower assembly 203 comprising a first blower 204 and a second blower 206 coupled (e.g., mounted) to the blower support frame 202. The blower support frame 202 may have a first side 207 (e.g., upstream side) facing the heat exchanger and a second side 208 (e.g., downstream side) facing away from the heat exchanger in an installed configuration of the system 200. The blowers 204, 206 (e.g., blower assembly) may be coupled to the blower support frame 202 via fasteners, pins, nuts and bolts, brazes, or other suitable fastening techniques. During an operative mode, the system 200 may receive a call to provide a conditioned air flow to a room or building. The blowers 204, 206 may be configured to induce an air flow 300 across the heat exchanger positioned upstream (e.g., relative to a direction of the air flow 300) of the blowers 204, 206. For example, the air flow 300 may be directed across the heat exchanger (e.g., an evaporator) in order to cool the air flow 300 before it is discharged from the system 200 toward the conditioned space. The air flow 300 may be a suction air flow induced by the blowers 204, 206. That is, the blowers 204, 206 may draw the air flow 300 across the heat exchanger and then direct the air flow 300 from the first side 207 of the blower support frame 202 to the second side 208 of the blower support frame 202. Thereafter, the air flow 300 may be discharged from the system 200 and directed to the conditioned space, such as via ductwork. It should be noted that in some embodiments, the blower assembly 203 may include fewer or more blowers than the blowers 204, 206 shown in the illustrated embodiment.

As illustrated, the blower support frame 202 may be formed from a plurality of structural or support members (e.g., rails, beams, posts, braces, bars, etc.) secured to one another. The blower support frame 202 includes a first section 210, a second section 212, and a third section 214, which are described in greater detail below with reference to FIG. 6. The first section 210, the second section 212, and the third section 214 may be arranged in series and may each be fluidly coupled to one another such that air flow 300 induced by the first blower 204 and/or the second blower 206 may pass between each of the first, second, and third sections 210, 212, 214 within blower support frame 202. The first blower 204 may be positioned within the first section 210 of the blower support frame 202, and the second blower 206 may be positioned within the third section 214 of the blower support frame 202, relative to gravity. The first section 210 and the second section 212 may generally be free of obstructions to enable generally unimpeded flow of air and condensate within the blower support frame 202 (e.g., within the first and second sections 210, 212). The third section 214 may be configured to house a motor (illustrated in FIG. 9) configured to drive rotation of the blowers 204, 206. It should be noted that, while a motor may be located in the third section 214, the third section 214 may still be in fluid communication with the first and the second sections 210, 212. Thus, the air flow 300 induced by the first blower 204 and the second blower 206 may also flow within and/or through the third section 214. Further, condensate that is formed on the heat exchanger and carried downstream towards the blower support frame 202 by the air flow 300 may also flow into the first and second sections 210, 212. As the condensate falls relative to gravity, the condensate may be collected by a condensate drain panel assembly 220. However, as discussed further below, the condensate drain panel assembly 220 may block condensate from flowing into the third section 214.

The condensate drain panel assembly 220 may include a first condensate drain panel 222, a second condensate drain panel 224, a cover panel 226 (e.g., vertical cover panel), and a main condensate drain pan 228. The condensate drain panel assembly 220 is configured to collect and drain condensate that is carried downstream of the heat exchanger and into the blower support frame 202. The condensate drain panel assembly 220 may also be configured to protect various features of the system 200 and/or other (e.g., surrounding) elements. For example, the first condensate drain panel 222 may be positioned within the blower support frame 202 and may extend from the first side 207 to the second side 208 of the blower support frame 202. The first condensate drain panel 222 may also be positioned above an insulative layer 230 of the system 200 (e.g., relative to gravity). In some embodiments, the insulative layer 230 may be coupled to the first condensate drain panel 222, but in other embodiments the insulative layer 230 may be offset from the first condensate drain panel 222. By placing the first condensate drain panel 222 above the insulative layer 230, the first condensate drain panel 222 may serve as a protective layer and may block liquid condensate from building up or pooling on the insulative layer 230, thereby avoiding adverse effects (e.g., degradation) that may otherwise result from impingement of the condensate on the insulative layer 230. Thus, the first condensate drain panel 222 may be a single panel configured to collect condensate that is blown or carried into the blower support frame 202 by the air flow 300. The first condensate drain panel 22 may also direct collected condensate out of the blower support frame 202 and away from the insulative layer 230. It should be noted that in some embodiments, the first condensate drain panel 222 may be comprised of separate panels for the first section 210 and the second section 212 that are connected to one another. The second condensate drain panel 224 may be positioned external to the blower support frame 202 (e.g., external to an inner volume defined by the blower support frame 202). As illustrated, the second condensate drain panel 224 may couple to the first side 207 of the blower support frame 202 and may be configured to extend from the first condensate drain panel 222 and away from the blower support frame 202 towards the main condensate drain pan 228 (e.g., in an upstream direction relative to a direction of the air flow 300, toward the heat exchanger, etc.).

The first condensate drain panel 222 may be coupled to the blower support frame 202 at an angle relative to horizontal, such that condensate collected by the first condensate drain panel 222 may be directed out of the blower support frame 202 and towards the second condensate drain panel 224, as described in greater detail below. Similarly, the second condensate drain panel 224 may extend from the first side 207 of the blower support frame 202 at an angle relative to horizontal and may be configured to direct the condensate towards the main condensate drain pan 228. The condensate collected within the main condensate drain pan 228 may then be discharged from the system 200 via drain (e.g., drain outlet), a conduit, or any suitable discharge flow path fluidly coupled to the main condensate drain pan 228. The flow of condensate within the blower support frame 202 and across the condensate drain panel assembly 220 will be described in greater detail below with reference to FIG. 8.

As described above, a motor (e.g., blower motor) may be disposed within the third section 214 of the blower support frame 202. The cover panel 226 may be configured to protect the motor from condensate that may be carried downstream of the heat exchanger by the air flow 300. For example, the cover panel 226 may be coupled to the first side 207 of the blower support frame 202 (e.g., coupled to structural members, posts, rails, etc. of the blower support frame 202) and may extend (e.g., vertically extend) upwards along the first side 207 of the blower support frame 202. That is, the cover panel may be disposed between a blower motor of the HVAC system and the heat exchanger in the assembled configuration of the condensate drain assembly. As described in greater detail below, the cover panel 226 may be sized to shield or protect the third section 214 of the blower support frame 202, thereby protecting the blower motor from condensate that may be carried downstream of the heat exchanger by the air flow 300.

Figure 6:
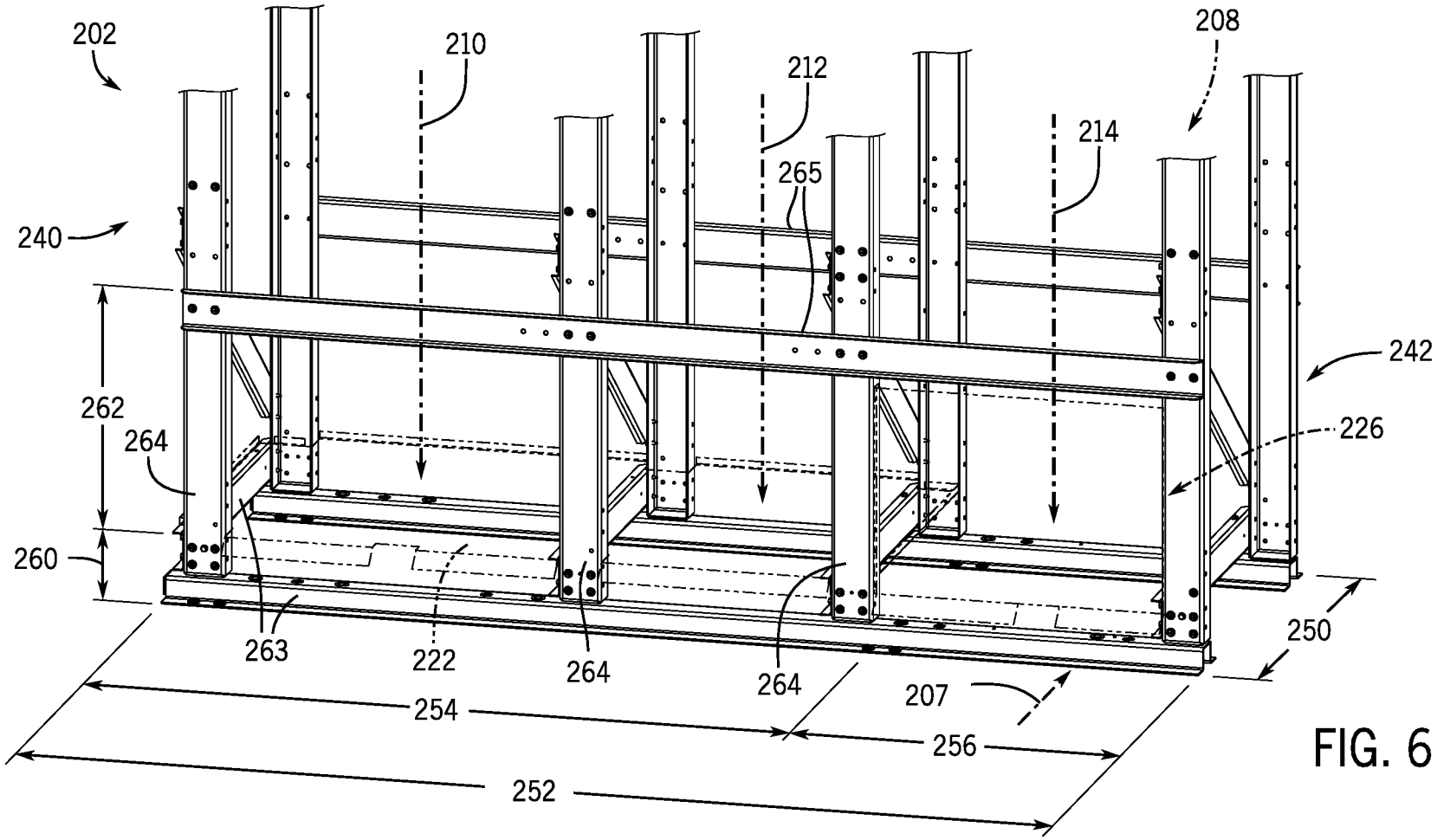
FIG. 6 is a front perspective view of an embodiment of a blower support frame for an HVAC unit, in accordance with an aspect of the present disclosure.

FIG. 6 is a front perspective view of an embodiment of the blower support frame 202 with the blowers 204, 206 removed. As described above, the blower support frame 202 may have the first side 207 and the second side 208. The blower support frame 202 may also have a third side 240 (e.g., lateral side) and a fourth side 242 (lateral side). In an installed configuration of the blower support frame 202, the first side 207 may face an upstream direction (e.g., relative to a direction of the air flow 300) and may face a heat exchanger across which the air flow 300 is directed, while the second side 208 may face a downstream direction. A depth 250 (e.g., dimension) of the blower support frame 202 may be defined as the distance from the first side 207 to the second side 208, and a width 252 (e.g., dimension) of the blower support frame 202 may be defined as the distance from the third side 240 to the fourth side 242 of the blower support frame 202. As illustrated, the first section 210 and the second section 212 of the blower support frame 202 may be adjacent to one another and collectively may extend a distance 254 from the third side 240 of the blower support frame 202. The third section 214 may extend a distance 256 from the second section 212 to the fourth side 242 of the blower support frame 202 and may be in fluid communication with the second section 212, as described above. The blower support frame 202 may also have a lower portion 260 (e.g., a base) and an upper portion 262, and the first condensate drain panel 222 may be positioned within and/or adjacent the lower portion 260. The lower portion 260 may generally include structural members 263 (e.g., rails) at the base of the blower support structure 202. The upper portion 262 may generally include structural members 264 (e.g., rails) extending from the lower portion 260 (e.g., base) and structural members 265 (e.g., rails) extending across the first, second, and third sections 210, 212, 214. The structural members 263, 264, and 265 may generally define an inner volume of the blower support structure 202.

Figure 7A:
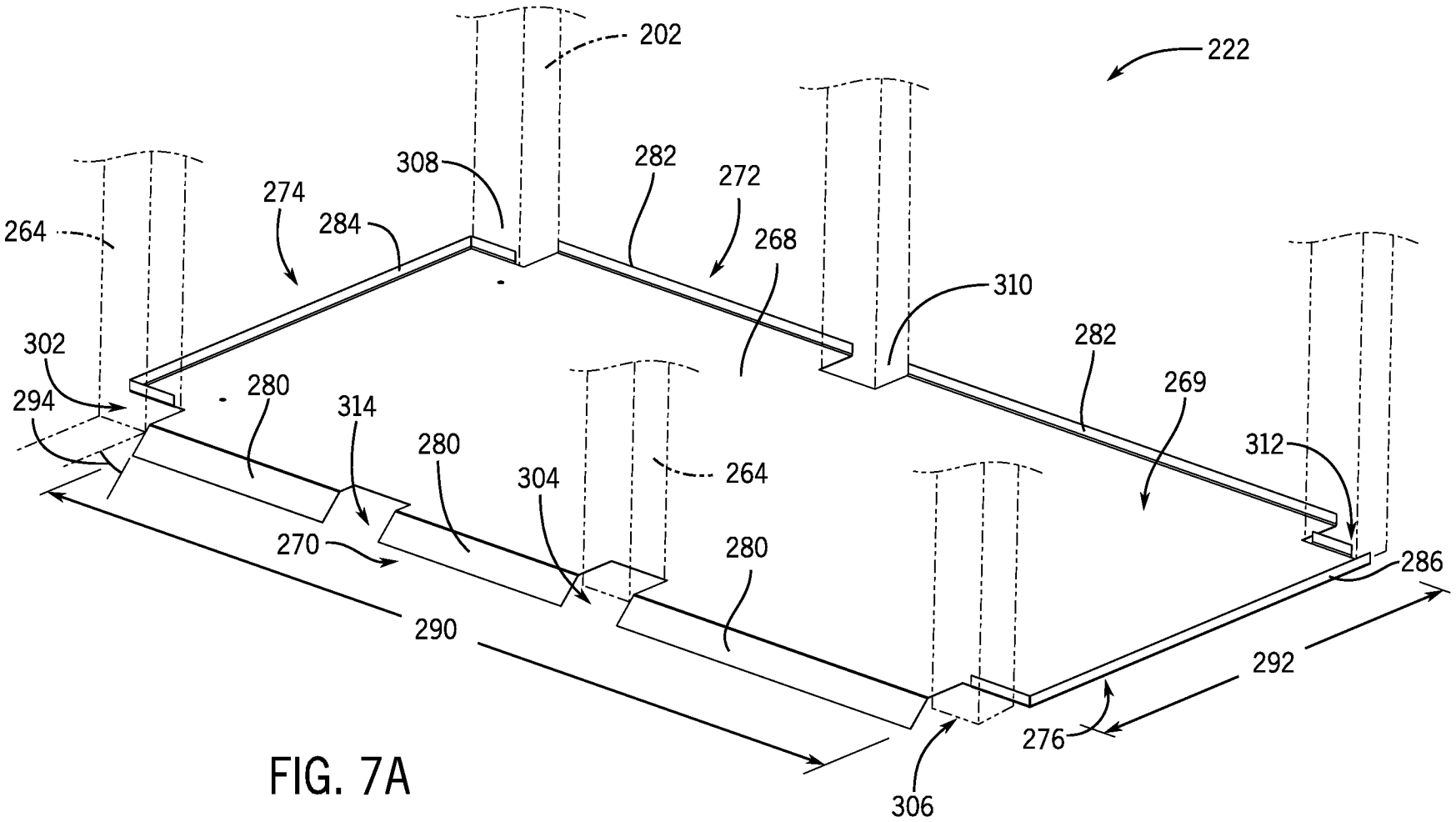
FIG. 7A is a perspective view of an embodiment of a condensate drain panel of a condensate drain system, in accordance with an aspect of the present disclosure.

FIG. 7A is a perspective view of an embodiment of the first condensate drain panel 222 of the condensate drain panel assembly 220. The first condensate drain panel 222 may have a main body 268 (e.g., a sheet, slab, plate, surface, condensate drain surface), a front side 270 (e.g., first side, upstream side), a back side 272 (e.g., second side, downstream side), and a pair of lateral sides 274, 276. The back side 272 may have a flanged edge 282, and the lateral sides 274, 276 may also have a flanged edge 284, 286 (e.g., side flange), respectively. Each of the flanged edges 282, 284, and 286 extend (e.g., vertically extend) from the main body 268 of the first condensate drain panel 222 to form a basin 269 (e.g., a condensate receptacle) configured to contain liquid condensate that falls onto the first condensate panel 222 (e.g., onto the main body 268) and may facilitate the drainage of the condensate towards the second condensate drain panel 224 (illustrated in FIG. 7B). The front side 270 may have a lip 280 (e.g., flange, extension, condensate drain lip) configured to couple to the second condensate drain panel 224 (not shown) to facilitate drainage of condensate collected by the first condensate drain panel 222. The lip 280 may extend from the main body 268 of the first condensate drain panel 222 and into a basin (e.g., condensate receptacle) of the second condensate drain panel 224 at an angle 294 relative to horizontal and/or relative to the main body 268, such that condensate flowing to the lip 280 (e.g., due to the angled orientation of the first condensate drain panel 222) may be directed onto the condensate receptacle of the second condensate drain panel 224 via gravity.

The front side 270 of the first condensate drain panel 222 may have a plurality of notches 302, 304, 306, and the back side 272 may also have a plurality of notches 308, 310, 312, each configured to facilitate coupling of the first condensate drain panel 222 with components of the system 200. For example, notches 302, 304, 306, 308, 310, and 312, may be used to secure the first condensate drain panel 222 to the blower support frame 202 (e.g., to structural members 263, 264, 265 of the blower support frame 202 illustrated in FIG. 6). As illustrated, a respective structural member 264 (e.g., vertical structural member) of the blower support frame 202 may extend through and/or within each of the notches 302, 304, 306, 308, 310, and 312, and fasteners, sliding joints, permanent joints, pins, screws, or other suitable securement features may be used to attach the first condensate drain panel 222 to the structural members 263, 264, 265 of the blower support frame 202. A notch 314 formed on the front side 270 of the first condensate drain panel 22 may be configured to enable coupling of the first condensate drain panel 222 to the second condensate drain panel 224, as described in greater detail below. In some embodiments, a sealant (e.g., silicone gel) may be disposed over or along perimetrical edges of each of the notches 302, 304, 306, 308, 310, 312, and 314. The sealant may mitigate, block, and/or prevent inadvertent flow of condensate between the first condensate drain panel 222, the various structural members, and/or the second condensate drain panel 224 positioned within the notches 302, 304, 306, 308, 310, 312, and 314.

In the illustrated embodiment, the first condensate drain panel 222 may also have a width 290 (e.g., dimension) and a depth 292 (e.g., dimension) that are substantially similar and/or correspond to the distance 254 and the depth 250, respectively, of the blower support frame 202 illustrated in FIG. 6. That is, the width 290 of the first condensate drain panel 222 may be equal to the distance 254 illustrated in FIG. 6, and the depth 292 of the first condensate drain panel 222 may be equal to the depth 250 illustrated in FIG. 6. In this way, when the first condensate drain panel 222 is installed with the blower support frame 202, the lower portion 260 of the first section 210 and the second section 212 of the blower support frame 202 may be protected or covered by the first condensate drain panel 222.

Figure 7B:
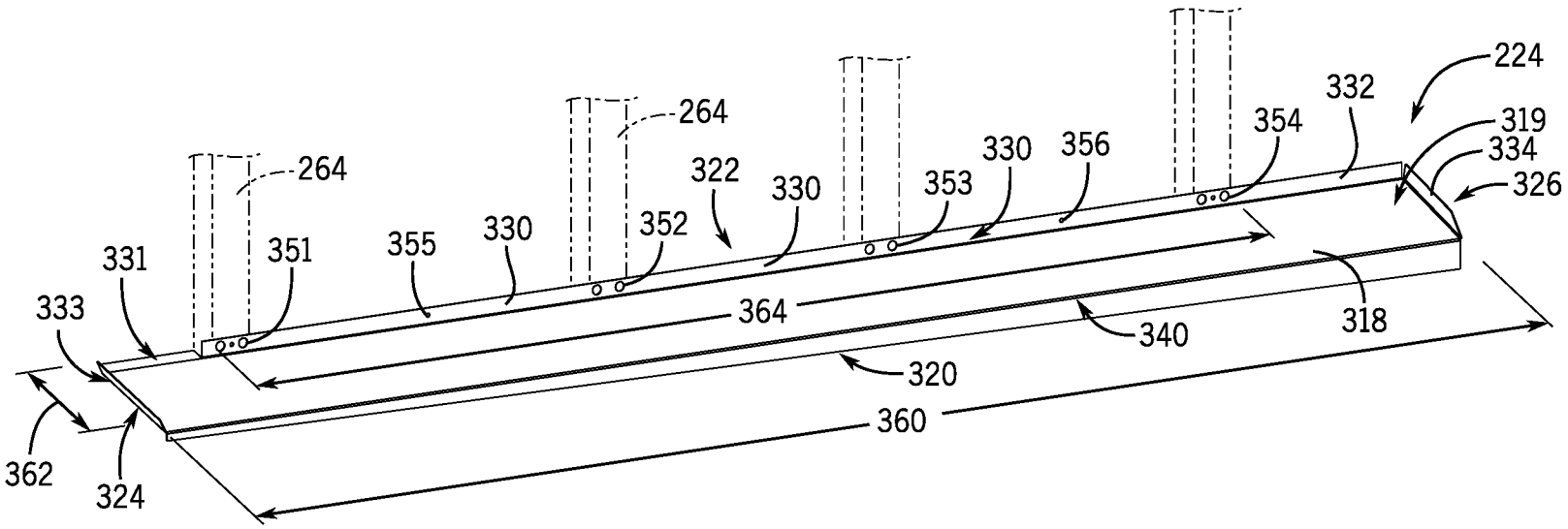
FIG. 7B is a perspective view of an embodiment of a condensate drain panel of condensate drain system, in accordance with an aspect of the present disclosure

FIG. 7B is a perspective view of an embodiment of the second condensate drain panel 224 of the condensate drain panel assembly 220. The second condensate drain panel 224 may have a main body 318 (e.g., a sheet, slab, plate, surface, condensate drain surface, etc.), a front side 320 (e.g., upstream side), a back side 322 (e.g., downstream side), and a pair of lateral sides 324, 326. The back side 322 may have a lip 330 (e.g., flange, extension, lip segments, condensate drain lip) extending from the main body 318 on the back side 322 of the second condensate drain panel 224. The lip 330 is configured to couple (e.g., engage, overlap) with the lip 280 of the first condensate drain panel 222. That is, when installed, the lip 330 of the second condensate drain panel 224 may be positioned underneath (e.g., relative to gravity) the lip 280. Thus, condensate flowing from the first condensate drain panel 222 may be collected by the second condensate drain panel 224 and further directed away from the blower support frame 202. Further, the overlapping configuration of the lip 280 and the lip 330 may mitigate inadvertent flow of the condensate from the first condensate drain panel 222 to a location or area external to the condensate drain panel assembly 220. The flow of condensate is described in greater detail below with reference to FIG. 8. On opposing sides of the lip 330 along the back side 322 of the second condensate panel 224 are a pair of flanged edges 331, 332 extending from the main body 318. The lateral sides 324, 326 may also have flanged edges 333, 334 (e.g., side flange), respectively, that extend from the main body 318. Similar to the flanged edges 282, 284, and 286 described above with reference to FIG. 7A, each of the flanged edges 331, 332, 333, and 334, in conjunction with the main body 318, may form a basin 319 (e.g., a condensate receptacle) configured to contain liquid condensate within the second condensate drain panel 224 and direct the liquid condensate out of the system 200 (e.g., HVAC system), as described in greater detail below. That is, condensate particles flowing from the first condensate drain panel 222 to the second condensate panel 224 may be directed into the basin 319 of the second condensate panel 224 as a result of the lip 280 of the first condensate panel 222 extending over the lip 330 and into the basin 319. The front side 320 may also have a lip 340 (e.g., flange, extension, condensate drain lip) configured to couple to (e.g., engage, overlap with) and extend into a basin (e.g., condensate receptacle) of the main condensate drain pan 228. The lip 340 may extend from the main body 318 of the second condensate drain panel 224 at an angle relative to horizontal and/or the main body 318 such that condensate flowing to the lip 340 may be directed into a condensate receptacle of the main condensate drain pan 228.

The back side 322 may also have a plurality of notches 351, 352, 353, 354 (e.g., formed in the lip 330) configured to facilitate coupling of the second condensate drain panel 224 with components of the system 200. For example, the notches 351, 352, 353, and 354 may be used to secure the second condensate drain panel 224 to the blower support frame 202. That is, structural members 264 of the blower support frame 202 may be positioned within each of the notches 351, 352, 353, and 354, and fasteners, pins, screws, or other suitable securement technique may be used to secure the second condensate drain panel 224 to the structural members 264 of the blower support frame 202. A coupling pad 355 may be configured to facilitate the coupling between the first condensate drain panel 222 and the second condensate drain panel 224 by aligning with the notch 314 of the first condensate drain panel 222. Such an alignment allows the first condensate panel 222 to be positioned correctly with respect to the second condensate drain panel 224 such that condensate may be removed from the system 200. Similarly, a coupling pad 356 may be configured to align with a notch of the cover panel 226, as described in greater detail with reference to FIG. 7C. In some embodiments, a sealant (e.g., silicone gel) may be placed over or along perimetrical edges of the notches 351, 352, 353, 354, and the coupling pads 355, and 356. As similarly described above, the sealant may mitigate, block, and/or prevent inadvertent flow of condensate between the first condensate drain panel 222, the various structural members 263, 264, 265, the second condensate drain panel 224, the notches 351, 352, 353, 354, and the coupling pads 355 and 356.

As shown in the illustrated embodiment, the second condensate drain panel 224 may have a width 360 (e.g., dimension) and a depth 362 (e.g., dimension). The depth 362 may be defined as the distance from the first condensate drain panel 222 to the main condensate drain pan 228 along the main body 318 (e.g., from the back side 322 to the front side 320). The lip 330 may also have a width 364 (e.g., dimension) that is substantially similar and/or corresponds to the width 252 of the blower support frame 202. The width 364 of the lip 330 may be shorter than the width 360 of the second condensate drain panel 224. Thus, the lip 330 may generally span the width 252 of the blower support frame 202 from the notch 351 to the notch 355 and includes the notches 352, 353, and the coupling pads 355, 356 formed therein, thereby directing condensate collected within the blower support frame 202 out of the system 200 (e.g., HVAC system).

Figure 7C:
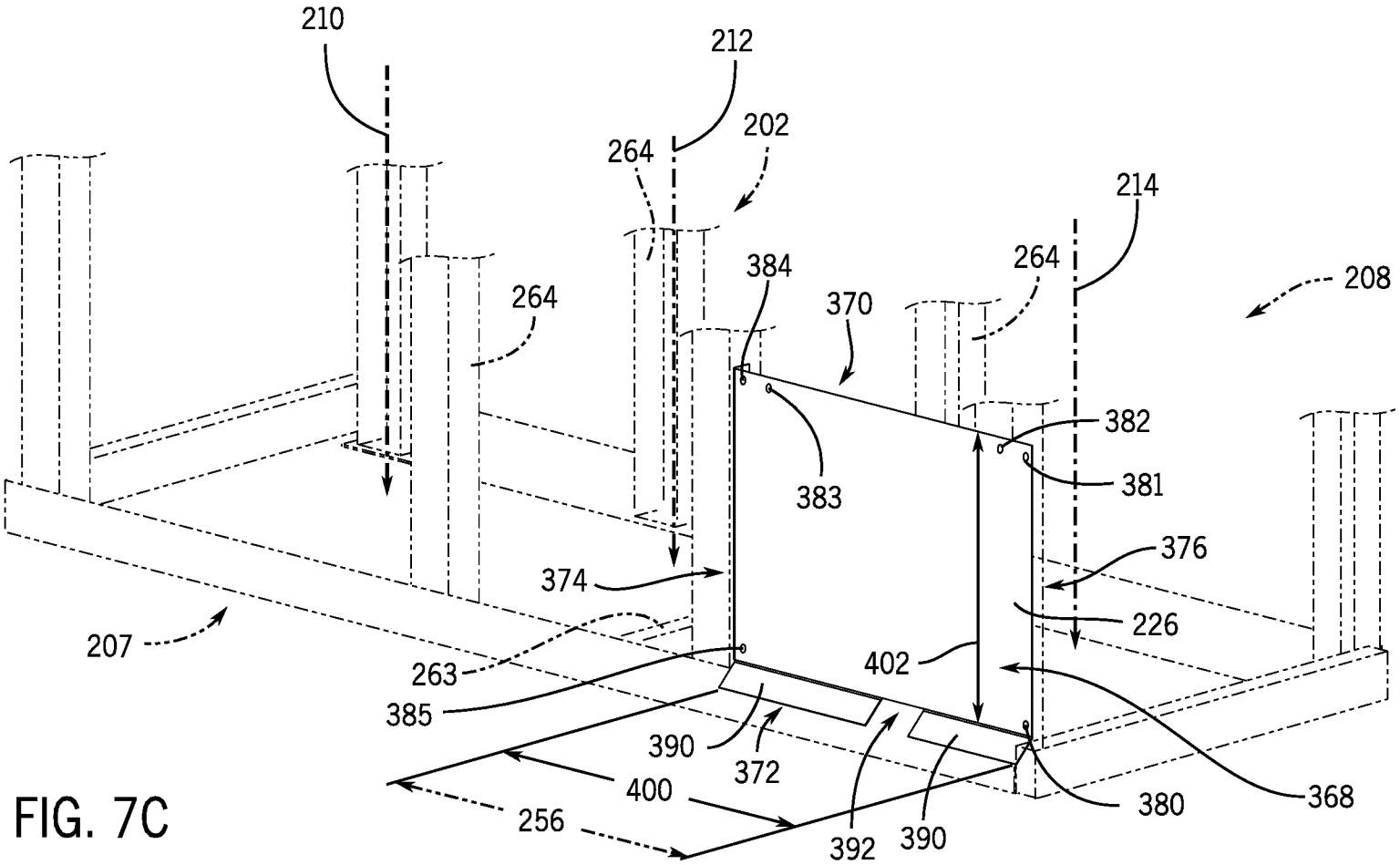
FIG. 7C is a perspective view of an embodiment of a cover panel of a condensate drain system, in accordance with an aspect of the present disclosure.

FIG. 7C is a perspective view of an embodiment of the cover panel 226 of the condensate drain panel assembly 220 of FIG. 5. The cover panel 226 may have a main body 368 (e.g., a sheet, slab, plate, surface, condensate drain surface), a top side 370, a bottom side 372, and a pair of lateral sides 374, 376. As illustrated, the cover panel 226 may be coupled to the blower support frame 202 via a plurality of fasteners 380, 381, 382, 383, 384, and 385. For example, the fasteners 380, 381, 382, 383, 384, and 385 may be configured to extend through the cover panel 226 and couple to structural members 263, 264, 265 of the blower support frame 202 in order to secure the cover panel 226 to the front side 207 of the blower support frame 202. The bottom side 372 may also have a lip 390 (e.g., flange, extension, condensate drain lip) extending from the main body 368 and configured to couple to (e.g., engage, overlap with) the lip 330 of the second condensate drain panel 224. The lip 390 may extend at an angle relative to horizontal, vertical, and/or the main body 368. When installed, the lip 390 may extend over the lip 330 (e.g., relative to gravity) of the second condensate drain panel 224. Therefore, condensate that impinges against the cover panel 226 may travel along the main body 368 and be directed into the second condensate drain panel 224. The lip 390 may also have a notch 392 formed therein that is configured to align with the coupling pad 356 of the second condensate drain panel 224. In some embodiments, a sealant (e.g., silicone gel) may be placed over or along perimetrical edges of the notch 392 and the coupling pad 356 to block, mitigate, and/or reduce inadvertent flow of condensate between the cover panel 226 and the second condensate drain panel 224.

The cover panel 226 may be positioned on the first side 207 of the blower support frame 202 (e.g., in a generally vertical orientation) in order to protect or shield a motor disposed within the third section 214 of the blower support frame 202. For example, the cover panel 226 may be secured to the first side 207 of the blower support frame 202 as described above and may have a width 400 (e.g., dimension) and a height 402 (e.g., dimension). The width 400 may be substantially similar to the width 256 of the third section 214 of the blower support frame 202 such that the cover panel 226 extends entirely or substantially entirely across the third section 214. The height 402 may be selected based on a height of the motor disposed within the third section 214. That is, the cover panel 226 may be configured to span across the front side 207 of the third section 214 of the blower support frame 202 at the length 252 of the third section 214 and may extend to the height 402 to block liquid condensate from entering the third section 214 of the blower support frame 202 having the motor. Condensate that impinges against the vertical cover panel 226 may be directed downwards via gravity to the lip 390, which may then direct the condensate to the second condensate drain panel 224 and out of the system 200, as described in greater detail below.

Figure 8A:
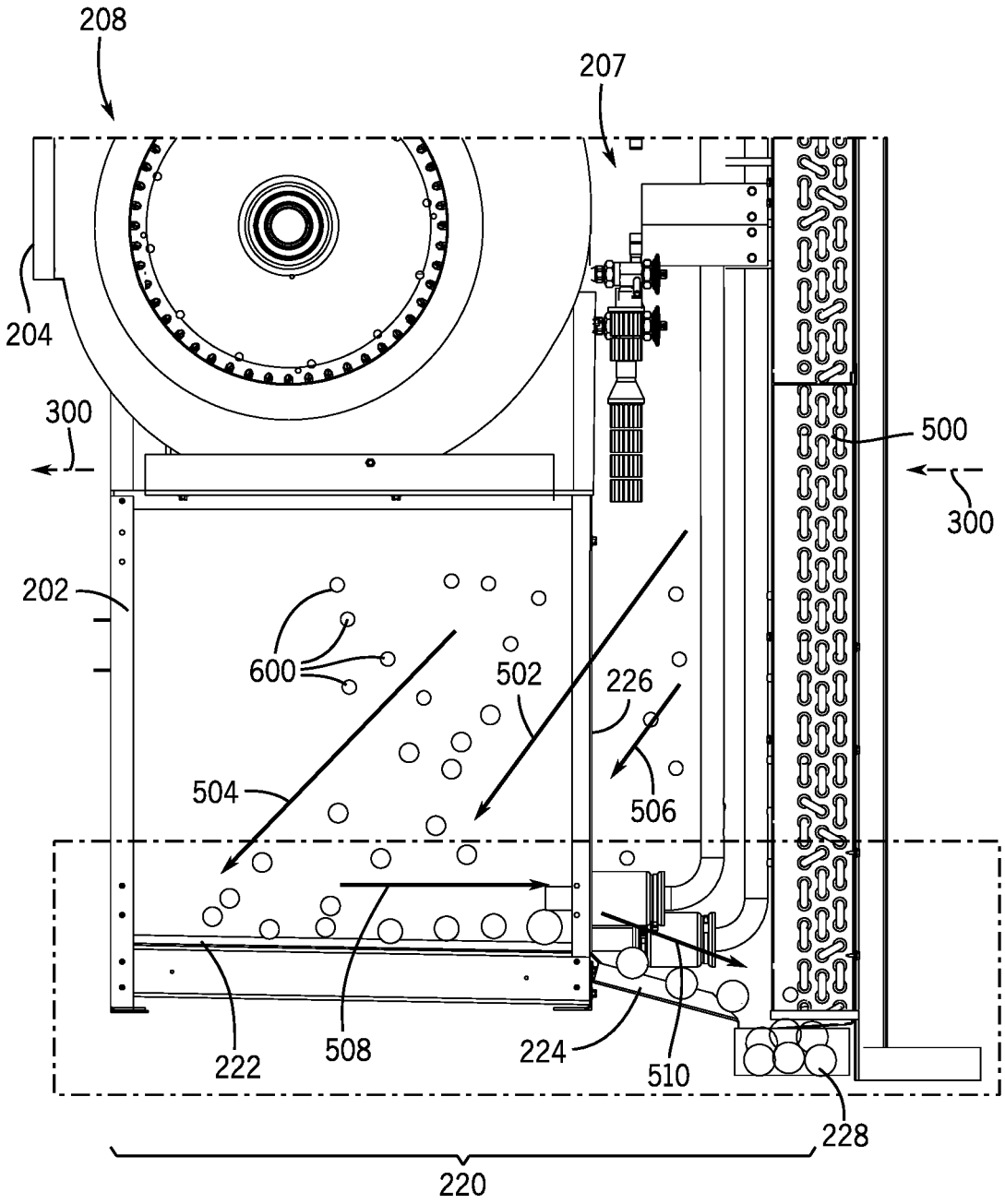
FIG. 8A is a side view of an embodiment of a blower support frame, a condensate drain system, illustrating flow of liquid condensate within an HVAC system and along the condensate drain system, in accordance with an aspect of the present disclosure.

FIG. 8A is a side perspective view of an embodiment of the blower support frame 202, the condensate drain panel assembly 220, illustrating various flow directions of liquid condensate collected and drained by the condensate drain panel assembly 220. As discussed above, when in a cooling mode, the blowers 204, 206 may be operated to induce the air flow 300 across an evaporator 500 to enable heat exchange between the air flow 300 and a refrigerant flowing within the evaporator 500. As the air flow 300 is cooled by the evaporator 500, liquid condensate may form on the evaporator 500, and it may be desirable to remove from the system 200 to avoid potential impact of the condensate on the system 200 and surrounding elements. Some of the liquid condensate may fall directly from the evaporator 500 via gravity and be collected by the main condensate drain pan 228 positioned beneath the evaporator 500 relative to gravity.

When environmental conditions (e.g., humidity levels and temperatures) are above a threshold value (e.g., greater than 60%, 70%, 80% humidity and/or greater than 80° F., 90° F., 100° F.), the system 200 (e.g., HVAC system) may be operated to increase the speed of the blowers or fans to satisfy a demand of a space conditioned by the system 200. As the speed of the blowers 204, 206 increases, the velocity (e.g., flow rate) of the air flow 300 induced across the evaporator 500 may also increase, which may cause condensate formed on the evaporator 500 to be blown or carried downstream of the evaporator 500. As illustrated, a plurality of condensate particles 600 (e.g., liquid condensate particles) may be propelled by the air flow 300 in various directions. For example, condensate particles may travel in a first condensate flow direction 502 toward the first side 207 of the blower support frame 202. As the speed of the blowers 204, 206 increases, the air flow 300 may propel condensate particles 600 in the first condensate flow direction 502 until the condensate particles 600 reach the first side 207 of the blower support frame 202. In some instances, upon reaching the first side 207 of the blower support frame 202, the condensate particles 600 may be propelled by the air flow 300 in a second condensate flow direction 504 toward the first section 210 and the second section 212 of the blower support frame 202. As illustrated, the air flow 300 may carry the condensate particles 600 in the second condensate flow direction 504 from the first side 207 towards the second side 208 of the blower support frame 202. As the condensate particles 600 are projected by the air flow 300, gravity may also act on the condensate particles 600 and force the condensate particles 600 downwards (e.g., relative to gravity) towards the condensate drain panel assembly 220. In this manner, the condensate particles 600 may be collected and removed from the system 200 via the condensate drain pan assembly 220. Thus, condensate particles 600 that reach the first section 210 or the second section 212 may ultimately collect in the first condensate drain panel 222. It should be noted that the second condensate flow direction 504 does not extend into or through the third section 214 of the blower support frame 202. Indeed, as discussed above, the cover panel 226 may be configured to block condensate particles 600 from reaching the third section 214 of the blower support frame 202 to protect a motor or other component (e.g., electrical component) disposed therein. Instead, the condensate particles 600 that are carried or blown by the air flow 300 towards the third section 214 of the blower support frame 202 may travel in a third condensate flow direction 506. As illustrated, the third condensate flow direction 506 extends from the evaporator 500 to the cover panel 226, and the cover panel 226 acts as a barrier to block condensate particles 600 from reaching the third section 214 of the blower support frame 202. Thus, condensate particles 600 that are carried in the third condensate flow direction 506 may contact the cover panel 226 and be forced towards the second condensate panel 224 via gravity.

As the condensate particles 600 within the first section 210 and the second section 212 move in the second condensate flow direction 504 towards the first condensate drain panel 222, the condensate particles 600 may collect and pool on the main body 268 of the first condensate drain panel 222. Upon reaching the first condensate drain panel 222, the condensate particles 600 may travel in a fourth condensate flow direction 508 towards the second condensate drain panel 224. As discussed above, the first condensate drain panel 222 may be coupled to the blower support frame 202 at an angle relative to horizontal such that gravity may act upon the condensate particles 600 collected on the main body 268 of the first condensate drain panel 222 and force the condensate particles 600 towards the second condensate drain panel 224 in the fourth condensate flow direction 508. The condensate particles 600 may move across the first condensate panel 222 in the fourth condensate flow direction 508, for example, from the second side 208 to the first side 207 of the blower support frame 202. Upon reaching the first side 207 of the blower support frame 202, the condensate particles 600 may travel in a fifth condensate flow direction 510. As discussed above, the second condensate drain panel 224 may be coupled to the first side 207 of the blower support frame 202 at an angle (e.g., relative to horizontal) such that gravity may act upon the condensate particles 600 on the second condensate drain panel 224 and force the condensate particles 600 towards the main condensate drain pan 228 in the fifth condensate flow direction 510. It should be noted that, as discussed above, the third condensate flow direction 506 may also direct condensate particles 600 towards the second condensate drain panel 224. Condensate particles 600 that travel in the third condensate flow direction 506 towards the third section 214 of the blower support frame 202 may collide with the cover panel 226 and may fall via gravity towards the second condensate drain panel 224 where the condensate particles 600 may combine with condensate particles 600 traveling in the fourth condensate flow direction 508 at the first side 207 of the blower support frame 202. Thereafter, the condensate particles 600 may then be directed in the fifth condensate flow direction 510 towards the main condensate drain pan 228. That is, condensate particles 600 traveling in each of the condensate flow directions 502, 504, 506, 508 may ultimately travel in the fifth condensate flow direction 510 to flow toward the main condensate drain pan 228 and may be removed from the system 200 (e.g., HVAC system).

Figure 8B:
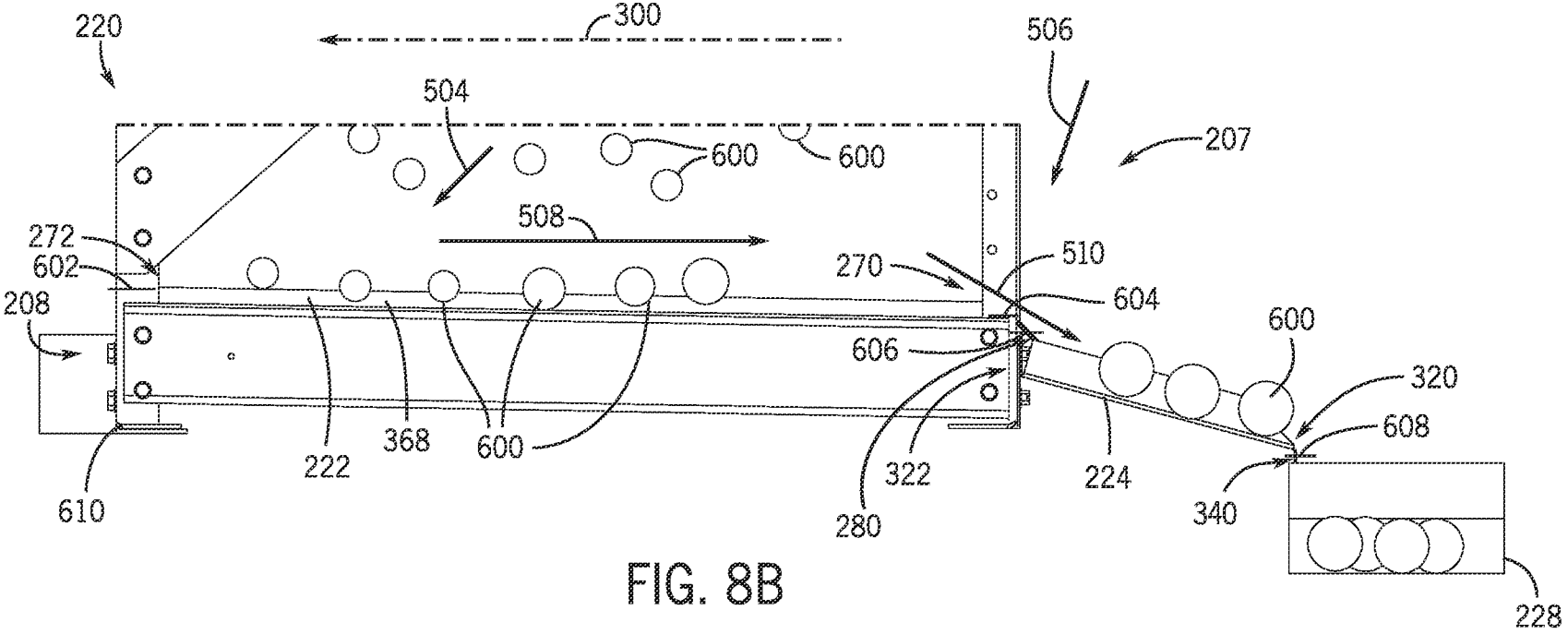
FIG. 8B is an expanded side view of an embodiment of a condensate drain system, illustrating flow of liquid condensate along the condensate drain system, in accordance with an aspect of the present disclosure.

FIG. 8B is an expanded view of an embodiment of the various condensate flow directions in which condensate particles 600 may travel through the system 200 and the condensate drain panel assembly 220. As discussed above, condensate particles 600 may be carried into the first section 210 and the second section 212 of the blower support frame 202 by the air flow 300 in the second condensate flow direction 504. As gravity forces the condensate particles 600 towards the first condensate drain panel 222, condensate particles 600 may collect on the main body 268 of the first condensate drain panel 222. The first condensate drain panel 222 may be coupled to the blower support frame 202 at an angle relative to horizontal such that the condensate particles 600 may be forced via gravity in the fourth condensate flow direction 508. For example, the back side 272 of the first condensate drain panel 222 may be coupled to the second side 208 of the blower support frame 202 at a position 602 along the blower support frame 202. The front side 270 of the first condensate drain panel 222 may be coupled to the first side 207 of the blower support frame 202 at a position 604 along the blower support frame 202. The position 602 may be greater than (e.g., elevated compared to) the position 604 relative to a base 610 of the blower support frame 202 to provide the angled orientation of the first condensate drain panel 222. Thus, condensate particles 600 collected on the main body 268 of the first condensate drain panel 222 may move in the fourth condensate flow direction 508 via gravity.

Similarly, the second condensate drain panel 224 may be coupled to the first side 207 of the blower support frame 202 at an angle relative to horizontal and/or relative to the first condensate drain panel 222 such that the condensate particles 600 may be forced via gravity in the fifth condensate flow direction 510. For example, the back side 322 of the second condensate drain panel 224 may be coupled to the first side 207 of the blower support frame 202 at a position 606 along the blower support frame 202. The front side 320 of the second condensate drain panel 224 may be coupled to the main condensate drain pan 228 at a position 608 along the main condensate drain pan 228. The position 606 may be greater than (e.g., elevated compared to) the position 608 relative to a direction of gravity such that condensate particles 600 on the main body 318 of the second condensate drain panel 224 may travel in the fifth condensate flow direction 510 via gravity and toward the main condensate drain pan 228. It should be noted that the position 604 may also be greater than (e.g., elevated compared to) the position 606 such that condensate particles 600 may travel from the first condensate drain panel 222 to the second condensate drain panel 224 via gravity.

Figure 9:
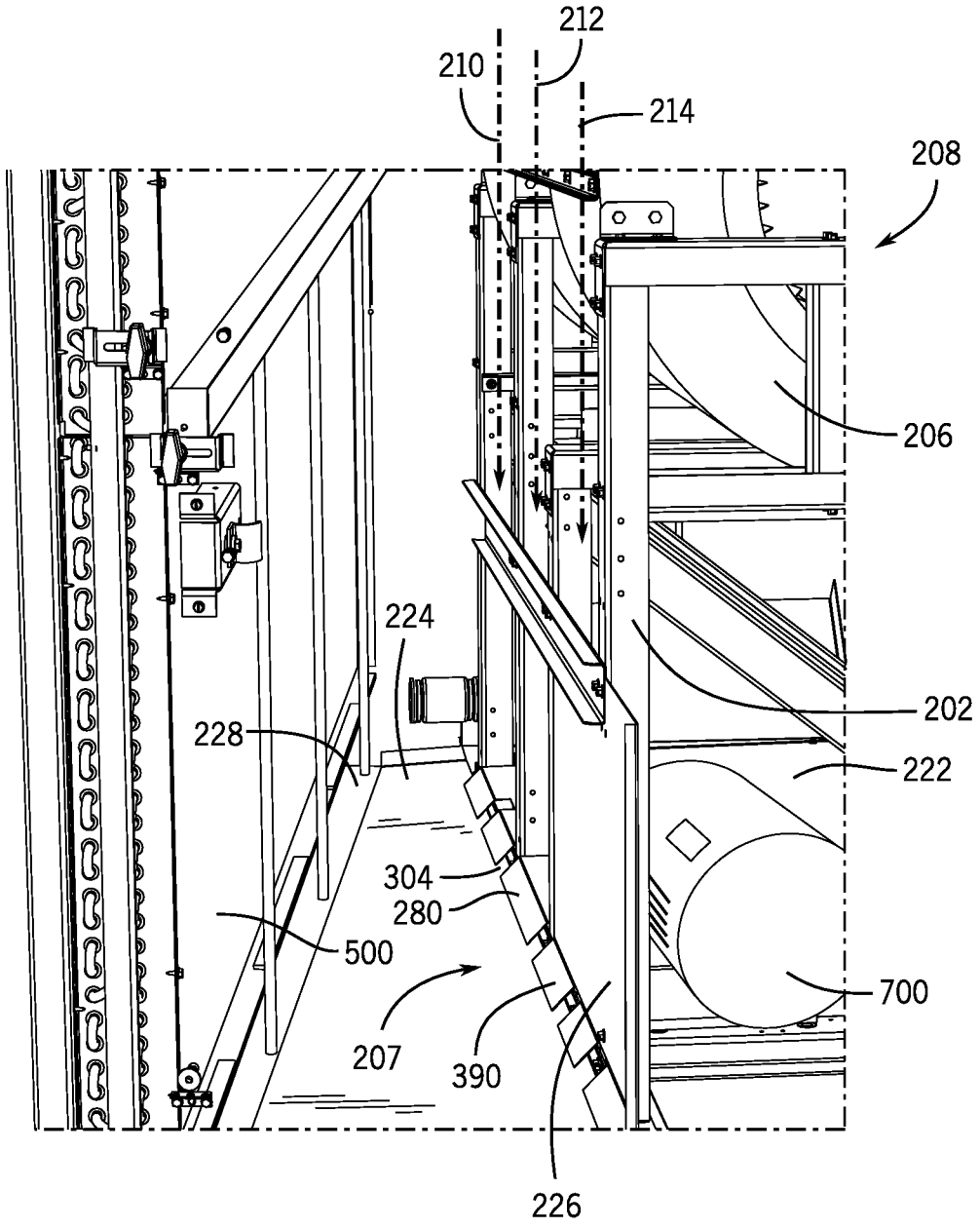
FIG. 9 is a perspective view of an embodiment of a condensate drain system installed with a blower assembly, in accordance with an aspect of the present disclosure.

Turning now to FIG. 9, a perspective view of an embodiment of the system 200 including a motor 700 is shown. As illustrated, the motor 700 may be positioned within the third section 214 of the blower support frame 202 and may be shielded or protected from contact with the condensate particles 600 by the cover panel 226. Condensate particles 600 that are carried from the evaporator 500 towards the third section 214 may collide with the cover panel 226 and may fall (e.g., along the cover panel 226) towards the second condensate drain panel 224. The lip 390 may be configured to facilitate the flow of condensate particles 600 from the cover panel 226 towards the second condensate drain panel 224. Similarly, the lip 280 may also be configured to facilitate the transfer of condensate particles 600 from the first condensate drain panel 222, positioned within the first and second section 210, 212 of the blower support frame 202, towards the second condensate drain panel 224. As described above, both the first condensate drain panel 222 and the second condensate drain panel 224 may be coupled to components of the system 200 at an angle relative to horizontal such that condensate particles 600 may be driven via gravity towards the main condensate drain pan 228. As illustrated in FIG. 9, in some embodiments, the lips 280 and 390 may be continuous. That is, the notch 314 of the lip 290 and the notch 392 of the lip 390 may be absent.

Figure 10:
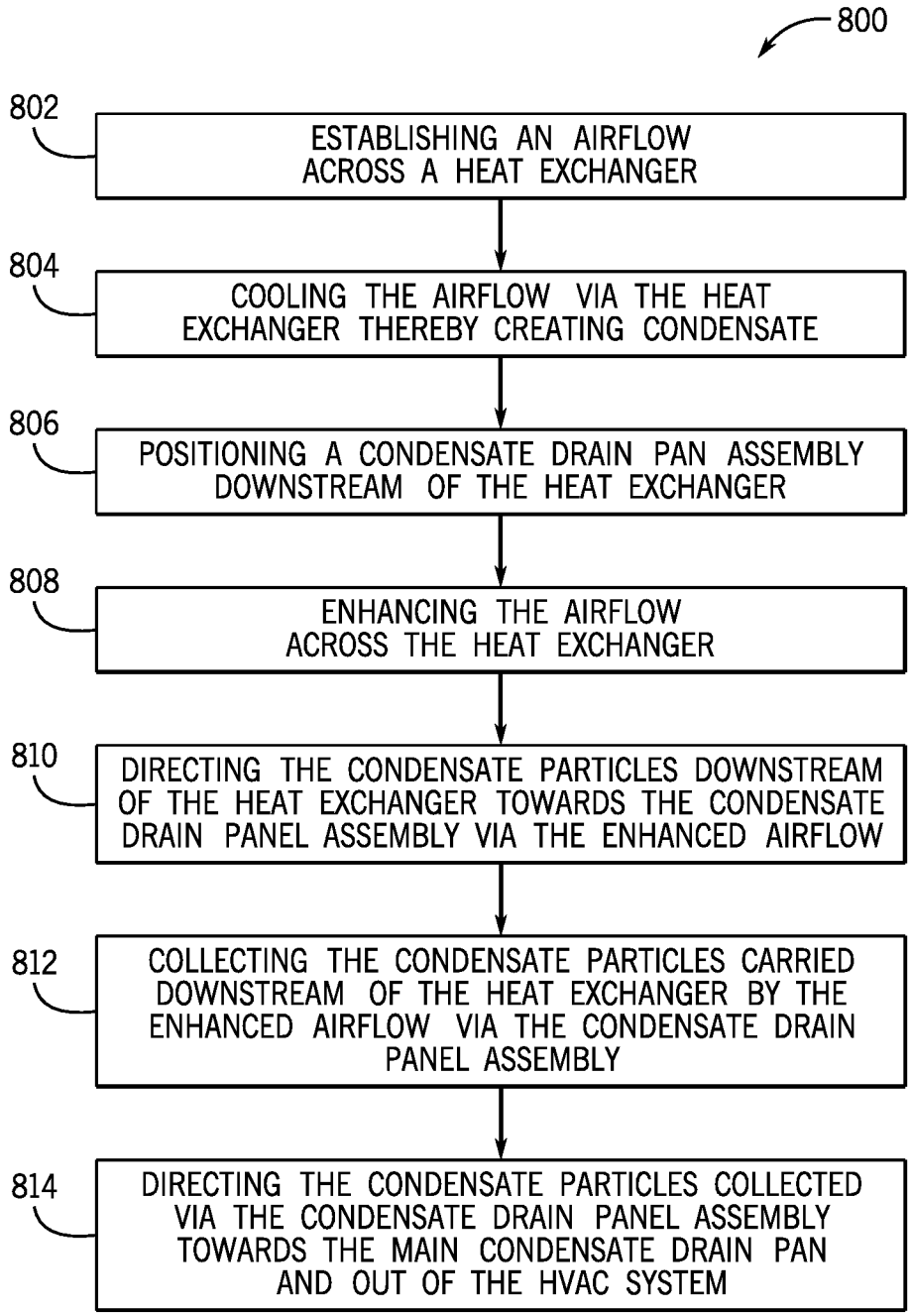
FIG. 10 is a process flow diagram illustrating an embodiment of a method for collecting condensate and enhancing an air flow in an HVAC unit, in accordance with an aspect of the present disclosure.

FIG. 10 is a process flow diagram illustrating an embodiment of a method 800 of enhancing an air flow in an HVAC unit. For example, the HVAC unit may be HVAC unit 10 and may include the system 200. It should be noted that the steps of the method 800 described herein may be performed in the order illustrated in FIG. 10 or in any other suitable order. Moreover, in some embodiments, some steps of the method 800 may not be performed and/or additional steps may be performed. First, the method 800 includes establishing (block 802) an air flow across a heat exchanger (e.g., evaporator 500). As previously described, the system 200 may include one or more blowers configured to establish the air flow (e.g., suction air flow) across the heat exchanger.

Further, the method 800 includes cooling (block 804) the air flow via the heat exchanger, which may cause formation of condensate particles on the heat exchanger. As previously described, when an air flow is directed across a heat exchanger, the air flow may be placed in a heat exchange relationship with a refrigerant circulated through the heat exchanger. As the air flow passes across the heat exchanger, moisture within the air flow may be cooled to its dew point and may form condensate particles on the heat exchanger. During normal operative conditions, the condensate particles may fall via gravity from the heat exchanger and into a drain pan positioned beneath the heat exchanger to be removed from the HVAC unit.

The method 800 further includes positioning (block 806) a condensate drain panel assembly downstream of the heat exchanger. As previously described, the condensate drain panel may be positioned downstream of the heat exchanger to protect components of the HVAC system from undesired effects that may be produced via the condensate particles carried downstream of the heat exchanger. In some embodiments, the step of block 806 may be the first step performed in the method 800 (i.e., before the step of block 802).

Further, the method 800 includes enhancing (block 808) the air flow directed across the heat exchanger. As previously described, when environmental conditions (e.g., humidity and temperature) exceed certain threshold values (e.g., greater than 70%, 80%, 90% humidity or greater than 80° F., 90° F., 100° F.), the HVAC unit may be operated to increase the speed of the blowers or fans to satisfy a demand (e.g., a cooling demand) of the space conditioned by the HVAC unit. Increased blower speed may result in an enhanced air flow (e.g., increased air flow rate) that may be capable of carrying or blowing condensate particles formed on the heat exchanger and propelling the condensate particles downstream towards certain components of the HVAC unit and/or towards surrounding elements.

Further, the method 800 includes directing (block 810) the condensate particles downstream of the heat exchanger towards the condensate drain panel assembly via the enhanced air flow. As previously described, an increased flow rate of the air flow across the heat exchanger may result in condensate particles being carried downstream of the heat exchanger towards the condensate drain panel assembly which can adversely impact certain components of the HVAC unit and/or surrounding elements.

The method 800 then includes collecting (block 812) the condensate particles carried downstream of the heat exchanger by the enhanced air flow with the condensate drain panel assembly. As previously described, certain components of the condensate drain panel assembly may be positioned downstream of the heat exchanger to collect and drain condensate particles blown or carried downstream of the heat exchanger. For example, some of the condensate particles may travel in a condensate flow direction within a blower support frame towards the first condensate drain panel. Other condensate particles may be carried in a different condensate flow directions towards the cover panel against which the condensate particles may collide and then be collected by the second condensate drain panel.

Further, the method 800 includes directing (block 814) the condensate particles collected via the condensate drain panel assembly towards the main condensate drain pan and out of the HVAC unit. As previously described, once the condensate particles are collected by certain components of the condensate drain panel assembly, the condensate particles may be directed out of the HVAC unit. For example, both the first and the second condensate drain panels may be coupled to components of the HVAC unit at an angle relative to horizontal such that any condensate particles present on the surface the first or second condensate drain panels may be directed towards the main condensate drain pan via gravity. As a result, condensate particles are blocked from collecting on certain components of the HVAC system, thereby limiting undesired effects of the condensate particles on the HVAC unit.

Providing condensate collection and drainage systems, in accordance with the present disclosure, can improve the collection and drainage of excess condensate that is carried downstream of the heat exchanger, thereby enabling operation of the HVAC system at enhanced air flow rates. Further, by configuring the condensate drain panel assembly as described above, the condensate drain assembly may provide protection to additional components of the HVAC system that would be otherwise unprotected in traditional systems. That is, use of the presently disclosed condensate drain panel assembly may reduce a likelihood of wear and degradation to the HVAC system and its components (e.g., electronics) that may be caused by water presence and/or air pressure during operation of the HVAC system.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a blower;

a blower support frame configured to support the blower of the HVAC system;

a first condensate drain panel coupled to the blower support frame and extending within the blower support frame beneath the blower at a first non-zero angle relative to horizontal;

a second condensate drain panel, separate from the first condensate drain panel, positioned external to the blower support frame and directly attached to the blower support frame via one or more fasteners at a second non-zero angle, different from the first non-zero angle, relative to horizontal, wherein the second condensate drain panel extends outwardly from the first condensate drain panel and from the blower support frame; and a drain pan configured to be positioned beneath an evaporator of the HVAC system, wherein the second condensate drain panel extends from the first condensate drain panel to the drain pan.

2. The HVAC system of claim 1, further comprising the evaporator, wherein the evaporator is positioned upstream of the blower support frame relative to a flow direction of air across the evaporator induced by the blower, and wherein the first condensate drain panel is positioned downstream of the second condensate drain panel relative to the flow direction of air across the evaporator.

3. The HVAC system of claim 1, further comprising a cover panel directly coupled to the blower support frame in a vertical orientation via one or more additional fasteners.

4. The HVAC system of claim 3, wherein the cover panel is disposed between a motor configured to drive rotation of the blower and the evaporator.

5. The HVAC system of claim 1, wherein the first condensate drain panel comprises a plurality of side flanges extending from a condensate drain surface of the first condensate drain panel.

6. The HVAC system of claim 5, wherein the first condensate drain panel comprises a condensate drain lip extending from the condensate drain surface to the second condensate drain panel.

7. The HVAC system of claim 6, wherein the condensate drain lip is a first condensate drain lip, the second condensate drain panel comprises a second condensate drain lip, and the first condensate drain lip and the second condensate drain lip overlap with one another.

8. The HVAC system of claim 1, wherein the second non-zero angle is greater than the first non-zero angle.

9. The HVAC system of claim 8, further comprising an insulative layer positioned beneath the first condensate drain panel relative to gravity.

10. A heating, ventilation, and air conditioning (HVAC) unit, comprising:

a blower assembly comprising a support frame and a blower coupled to the support frame;

a condensate drain system, comprising:

a first panel coupled to the support frame and extending within the support frame at a first non-zero angle relative to horizontal, wherein the first panel is positioned beneath the blower relative to gravity and is configured to capture condensate and direct the condensate out of the support frame; and a second panel, separate from the first panel, positioned external to the support frame and directly coupled to the support frame at a second non-zero angle, different from the first non-zero angle, relative to horizontal, wherein the second panel extends outwardly from the first panel and from the support frame and is configured to direct the condensate from the first panel to a drain pan of the HVAC unit; and an evaporator, wherein the blower is configured to induce an air flow across the evaporator, and the second panel is positioned upstream of the first panel relative to a flow direction of the air flow across the evaporator;

wherein the first panel comprises a first drain lip extending into a condensate receptacle of the second panel, and the second panel comprises a second drain lip extending into a condensate receptacle of the drain pan.

11. The HVAC unit of claim 10, further comprising the drain pan, wherein the drain pan is positioned beneath the evaporator relative to gravity.

12. The HVAC unit of claim 10, wherein the blower assembly comprises an additional blower configured to induce the air flow across the evaporator and a motor coupled to the support frame and positioned beneath the additional blower relative to gravity, and the condensate drain system comprises a cover panel coupled to the support frame between the motor and the evaporator.

13. The HVAC unit of claim 10, wherein the second panel is directly coupled to the support frame via one or more fasteners.

14. The HVAC unit of claim 10, wherein the first panel and the second panel are configured to direct the condensate toward the drain pan in a condensate flow direction opposite the flow direction of the air flow across the evaporator.

15. A condensate drain assembly for a heating, ventilation, and air conditioning (HVAC) system, comprising:

a first condensate drain panel configured to couple to a blower support frame of the HVAC system at a first non-zero angle relative to horizontal and beneath a blower supported by the blower support frame relative to gravity;

a second condensate drain panel, separate from the first condensate panel, configured to directly couple to the blower support frame and extend outwardly from the blower support frame, wherein the second condensate drain panel is configured to be disposed at a second non-zero angle relative to horizontal, wherein the second non-zero angle is greater than the first non-zero angle; and a drain pan configured to be disposed beneath a heat exchanger of the HVAC system relative to gravity, wherein the second condensate drain panel extends from the first condensate drain panel to the drain pan in an assembled configuration of the condensate drain assembly.

16. The condensate drain assembly of claim 15, wherein the first condensate drain panel comprises a first condensate drain panel main body and a lip extending from the first condensate drain panel main body, the second condensate drain panel comprises a second condensate drain panel main body and a lip extending from the second condensate drain panel main body, and the lip of the first condensate drain panel and the lip of the second condensate drain panel couple to and overlap with one another in the assembled configuration of the condensate drain assembly.

17. The condensate drain assembly of claim 16, wherein the second condensate drain panel comprises an additional lip extending from the second condensate drain panel main body on a side of the second condensate drain panel main body opposite the lip of the second condensate drain panel, and the additional lip is configured to extend into the drain pan in the assembled configuration of the condensate drain assembly.

18. The condensate drain assembly of claim 17, comprising a cover panel configured to be coupled to the blower support frame in a vertical orientation, wherein the cover panel comprises a cover panel main body and a lip extending from the cover panel main body, the lip of the cover panel and the lip of the second condensate drain panel couple to and overlap with one another in the assembled configuration of the condensate drain assembly, and the cover panel is disposed between a blower motor of the HVAC system and the heat exchanger in the assembled configuration of the condensate drain assembly.

* * * * *